US005092705A

United States Patent [19]

Raswant

[11] Patent Number: 5,092,705

[45] Date of Patent: Mar. 3, 1992

[54] METHOD OF CONTROLLING PEDESTRIAN AND VEHICULAR TRAFFIC FLOW

[76] Inventor: Subhash Raswant, 84-49 168th St., Apt. 1U, Jamaica, N.Y. 11432

[21] Appl. No.: 611,784

[22] Filed: Nov. 13, 1990

[51] Int. Cl.[5] ..... E01C 1/02

[52] U.S. Cl. ..... 404/1; 340/925; 340/944

[58] Field of Search ..... 404/1; 340/916, 925, 340/944

[56] References Cited

U.S. PATENT DOCUMENTS 4,927,288 5/1990 Raswant ..... 404/1

FOREIGN PATENT DOCUMENTS 700823 3/1931 France ..... 404/1

OTHER PUBLICATIONS

*American City Magazine*, vol. 105, "Walk Signals for Pedestrians", W. A. Van Duzer, 5-1937.

*Primary Examiner*—David J. Bagnell

*Attorney, Agent, or Firm*—Henry R. Lerner; Andrew S. Langsam

[57] ABSTRACT

A system for controlling vehicles and pedestrians on intersecting one-way roadways. Vehicles on a first one-way street are only allowed, with a "go" signal to either cross the intersection and continue on the street or to turn onto the intersecting one-way street. The vehicles on the intersecting, second one-way street are stopped while vehicles on the first street are moving. During this time pedestrians are allowed to cross in front of the stopped vehicles on the second one-way street. Then, when the light changes, the vehicle traffic on the second one-way street are only allowed to turn onto the first one-way street, i.e., they are blocked from crossing the intersection and continuing onto the second one-way street. During this time, the vehicles on the first one-way street are blocked, too, from entering the intersection. During this time, pedestrians may cross between adjacent corners to the stopped vehicles on the first one-way street and, at the same time, between opposite corners of the second one-way street, downstream of the portion of the intersection. Intermodal conflict or friction is thus eliminated.

12 Claims, 2 Drawing Sheets

METHOD OF CONTROLLING PEDESTRIAN AND VEHICULAR TRAFFIC FLOW

BACKGROUND OF THE INVENTION

The present invention relates to an integrated street and sidewalk network for rapid and efficient movement of vehicles (cars, trucks, taxis, etc.) and pedestrians. When implemented, the method provides smooth, continuous flow of traffic, both vehicular and pedestrian, while decreasing intermodal conflict, also known as friction, between the two forms of traffic flow. More specifically, the present invention relates to providing a method and system for controlling vehicular and pedestrian traffic on intersecting streets such that the vehicular traffic moves in a relatively continuous manner and, in addition, the pedestrian traffic pattern does not unnecessarily impact or retard the flow of the vehicular traffic. The present method and system may be easily superimposed onto existing street networks. It is easiest to understand and implement the present invention onto street networks which are substantially perpendicular to one another and, for present purposes, the present invention can be most easily appreciated when superimposed onto the New York City avenue, cross-street and sidewalk system.

According to the method and system, pedestrians, as well as vehicles, can reach their desired goals or locations along the road/sidewalk network. The system provides for faster vehicular traffic flow and gridlock is substantially avoided. It is a specific object of the present invention to reduce intermodal conflict or friction. This is defined as the backing up of vehicles or impedance to the smooth flow of vehicular traffic on streets as a consequence of pedestrians crossing, within crosswalks, in the same direction as the allowed direction of vehicle flow. Conventionally, i.e., without the superimposing of the present invention on a street and avenue system of roadways, vehicular traffic must wait until pedestrians complete their path across a crosswalk prior to the vehicle crossing the crosswalk and entering onto an adjacent street. The present invention relates to a method of controlling the movement of vehicles on the streets and for directing pedestrians across the crosswalks so that pedestrians will not impede on the flow of the vehicles. In this manner, intermodal conflict is reduced and vehicle traffic flow is increased.

DESCRIPTION OF THE PRIOR ART

A conventional roadway intersection has two streets, generally perpendicular to one another, with vehicular traffic capable of flowing in both directions on each of the streets. Traffic signals control the movement of the vehicles. In cities, sidewalks are provided for pedestrians to safely move about. They, too, are often directed by traffic signals. Conventionally, these signals are of the "Walk"/"Don't Walk" type which are synchronized with the vehicle traffic signals.

Considering a first of a network of streets as allowing vehicular traffic to travel in the North and South directions, the intersecting street would then allow vehicles to travel in the East and West directions. In New York City, in the midtown area, for example, wide avenues carry vehicles North and South, while intersecting, narrow streets carry traffic East and West. Currently, a backing up or impedance to smooth and continuous vehicular traffic occurs when a vehicle travelling in a first direction, northerly, for example, on an avenue seeks to make a right or left turn onto the intersecting street to travel easterly or westerly. More specifically, the vehicle travelling northerly must await until the pedestrians cross the intersecting street and clear the crosswalk, prior to making the righthand or lefthand turn onto the intersecting street. In busy cities and especially during lunch hours on pleasant weather days, only a very few cars can transfer from a first avenue to the intersecting street. This is because of the large number of pedestrians. Similarly, a car travelling, again in the first or, for example, in the northerly direction on the avenue, in order to travel on the intersecting street in a westerly direction, i.e., make a left turn onto the connecting street, must also wait in the middle of the intersection until the cars travelling in the southerly direction on the same street clear the intersection (if a two-directional avenue) and then, after being sure that it is safe to cross in front of the oncoming southerly traffic, the vehicle must be also sure that the crosswalk (connecting passengers from the southwest and northwest corners) is clear of pedestrians, prior to turning and then increasing speed on the westerly directed street. This waiting, of course, impacts on the smooth flow of vehicular traffic and can easily result in gridlock and driver frustration.

The present invention relates to a system or method designed to facilitate a more continuous and smooth flow of vehicular traffic by substantially eliminating left turns across oncoming traffic. In addition, by redirecting pedestrian flow the intermodal friction caused by pedestrians in the crosswalk is also substantially reduced, if not totally eliminated.

Gridlock, as mentioned above, is a common problem confronting crowded cities and generally can occur when a first intersection becomes blocked by either vehicles desiring to make lefthand turns from streets carrying traffic in two directions (compounded by the necessity of awaiting pedestrians to clear the crosswalks) or by vehicles making either right or lefthand turns from one-way streets, since they must await pedestrian clearance of the crosswalks. The New York Times, on Jul. 17, 1988, on page E7 published an article relating to gridlock and its tremendous negative impact on metropolitan streets and quality of life for city dwellers. Thus, a solution to the vehicular gridlock problem has long been sought. My U.S. Pat. No. 4,927,288 offers a simple and highly efficient means for eliminating the possibility of vehicle gridlock. It also provides for better traffic flow on existing street networks. I hereby incorporate by reference the entire specification, teaching and drawings of my U.S. Pat. No. 4,927,288 (hereinafter referred to as "the '288 patent").

The '288 patent discloses a road traffic network comprised of fundamental "building blocks" which are themselves comprised of a first endless loop or roadway of one-way traffic flow; a second endless loop or roadway of one-way traffic flow, completely surrounding the first endless loop and having traffic flowing oppositely in direction to the traffic flow of the first loop; and a loop to loop interconnecting roadway, extending between the two loops which allows traffic to transfer from either of the loops, to the other loop, by merger and not by crossing in front of oncoming traffic. The loop to loop interconnecting roadway, between the endless loops, provides vehicular traffic with the ability to freely transfer from one loop to another, without intersecting, i.e., crossing over traffic on the other loop.

For a more complete understanding of the loop roadway system, reference should be made to the '288 patent.

The direction or flow of vehicle traffic, on each portion of the loop to loop interconnect roadway is such that vehicular traffic flows from one loop to another by easily merging into the directional flow of traffic on the transferee loop and is in full conformity with the directional pattern established for the one-way loops themselves. A plurality of loop to loop interconnects, between the pair of one-way traffic loops, can be provided so that more than a single loop to loop interconnect roadway allows traffic to transfer from one loop to its adjacent loop. In addition, additional loops can be provided to the basic network with each additional loop surrounding or being fully encircled by its immediately adjacent loop and providing traffic flow in the opposite direction to the adjacent loop. In addition, as mentioned, each associated pair of adjacent, one-way endless loops necessarily requires at least one loop to loop interconnect roadway which, in one of the preferred forms of the invention disclosed in the '288 patent, can be a pair of adjacent one-way streets, like 43rd Street and 44th Street, in opposite directions or can be a single two-directional roadway, like 42nd Street in New York City. Such a road network, fully disclosed in U.S. Pat. No. 4,927,288, fully eliminates turns across oncoming traffic which oftentimes is the direct cause of traffic backups and potential gridlock.

Although the '288 patent is effective at eliminating vehicular gridlock and provides the smooth and continuous flow of vehicular traffic on existing roadways, it is not, however, directed to facilitating pedestrian flow nor is there any discussion nor solution to the problem of intermodal conflict or friction. Thus, there exists a need for integrating the method and system of regulating vehicular traffic on the loop and interconnect roadway network of the '288 patent with a system for directing pedestrians so that they can safely and quickly cross from one sidewalk corner to another and not impact on the vehicle flow. In addition, the present method and system reduces intermodal conflict or friction which, as mentioned, is a direct result of vehicles waiting until pedestrians clear crosswalks prior to making turns onto that portion of the intersecting roadway across which the crosswalk extends. The present invention accomplishes these purposes in a manner to be described.

SUMMARY OF THE INVENTION

The present invention relates to a method and system for controlling pedestrian traffic from city block corner to city block corner by first controlling the flow of vehicular traffic on the streets or roadways. When the present invention is integrated with the traffic network described in the '288 patent, a comprehensive solution to vehicular and pedestrian traffic flow is provided. In its preferred embodiment, the present invention relates to a method of controlling vehicles and pedestrian traffic on the loop roadway system described in the '288 patent, integrated with sidewalks, but this invention is not limited to that environment. However, for ease of illustration purposes, the present invention will be described and is best understood in connection with that loop roadway network system.

As previously mentioned, the basic and fundamental building block of the vehicular traffic flow system shown in the '288 patent comprises a pair of endless loops having one-way traffic on each loop with the direction of traffic flow on each loop being opposite to the direction of traffic flow on the adjacent loop. Vehicles may transfer from one loop to an adjacent loop by a loop to loop interconnecting roadway which, in the preferred embodiment, is a pair of streets, adjacent to one another, having traffic flow in opposite directions to one another. In this manner, vehicular traffic, flowing on a first loop can, if desired, transfer onto the other loop by use of the interconnecting roadway. Similarly, vehicular traffic on the second loop can transfer onto the first loop by using the oppositely directed portion of the loop to loop interconnecting roadway.

In a preferred embodiment of the present invention, the traffic lights at each intersection are timed to provide continuous and smooth pedestrian and vehicle traffic flow. The timing of the go and stop segments of the traffic signal will, of course, depend upon many variables as for example, volume of vehicle and pedestrians carried by the streets and sidewalks; time of day, day of week and, of principal importance to the present invention, the length of time anticipated for the pedestrians to cross the wider of the two intersecting streets. Since the present invention is desirably superimposed on my traffic loop network system, the controlling parameter for stoppage of the vehicle traffic on the loops is the amount of time it takes for the pedestrians to cross in front of the stopped vehicles on the loops. Stated otherwise, since my traffic loop network system only stops vehicular traffic so as to enable pedestrians to cross from corner to corner, i.e., without pedestrians there is no need for a traffic signal to ever stop vehicular traffic flow, the flow of vehicular traffic is stopped only for that period of time to allow pedestrians to cross from corner to corner.

According to the preferred embodiment, with the present invention superimposed on my loop network system in New York City, the traffic lights are timed such that a green signal for loop portions (the north-/south avenues) of the network occurs for about 40 seconds while traffic on the loop to loop interconnecting roadways (the east and west side streets) are stopped for the same time interval. After the 40 second interval expires, the vehicular traffic on the loop portion of the network is stopped by means of a red light signal for about 20 seconds. Vehicular traffic from the interconnecting roadway is allowed to proceed onto the loop portion of the network for the same 20 seconds.

With a green light facing the oncoming loop traffic and a red light facing the oncoming loop to loop interconnect traffic, pedestrians can cross, in the crosswalk in front of the stopped loop to loop interconnect traffic. Alternatively, with the traffic on the loops facing a red light and the traffic on the loop to loop interconnects having a green light, pedestrians can cross in front of the stopped loop traffic and, in addition, can cross between the corners of the far side of the intersection, with respect to the loop to loop traffic, since no traffic is then permitted to cross the intersection and enter the successive portion of the loop to loop interconnects but, rather, all traffic from loop to loop interconnects must, at every intersection, enter onto the loops. The present invention is more easily understood in connection with the following brief and detailed description of the drawings and invention.

DETAILED DESCRIPTION OF THE DRAWINGS AND THE INVENTION

Figure 1:
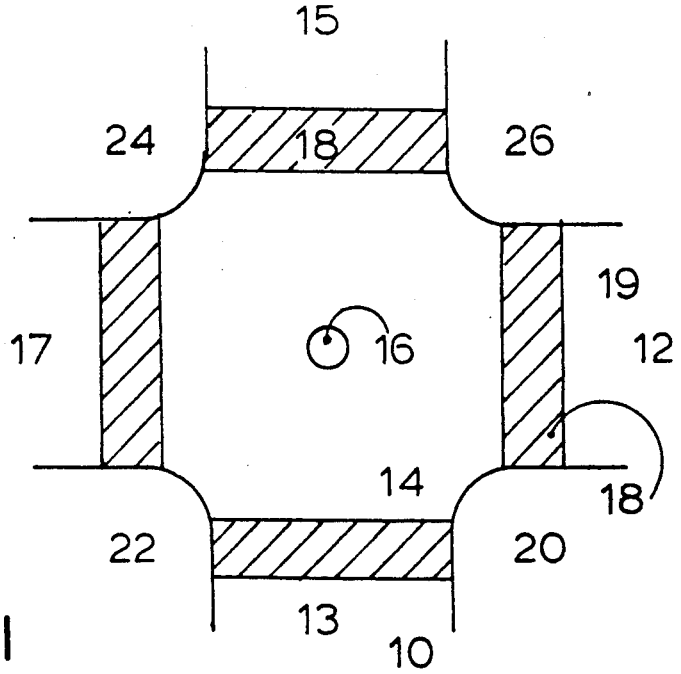
FIG. 1 is a schematic, representational birds-eye view of an existing and conventional roadway intersection, each road being capable of carrying two-way traffic with four crosswalks for pedestrians.

FIG. 1 shows a birds-eye view of a conventional road across intersection. A first roadway 10, for illustration purposes, has two-way traffic flow in the north and south directions intersects a second road or avenue 12. Road 12 carries two-way traffic in the east and west directions. An intersection 14 is thus defined. A traffic light 16 is generally centrally located in the intersection 14 and provides traffic signals for the vehicles in all four directions so that traffic travelling east and west along street 12 and north and south along road 10 knows when it is safe and permissible to pass through the intersection and when it is unsafe and illegal to continue through the intersection. This is, of course, the conventional roadway and vehicle traffic flow system. Four crosswalks 18 are usually painted or otherwise indicated across the roads 10 and 12 and provide a safe area for pedestrians to cross the roads. For ease of illustration and understanding of the present invention, corner 20 is located at the southeast corner of the intersection 14, corner 22 at the southwest corner of the intersection; corner 24 at the northwest corner of the intersection; and corner 26 at the northeast corner of the intersection.

When a vehicle travels northerly, for example, on road portion 13 of road 10, with a green light being indicated on traffic light 16, the vehicle can, unless otherwise indicated by signs, go straight through the intersection, continuing onto the other road portion 15 of road 10. Alternatively, the vehicle may make a right turn onto road 12, unless road 12 is a one-way street carrying traffic only in the East to West direction. In addition, the vehicle may pull into intersection 14, wait until oncoming southerly directed traffic clears the intersection or is sufficiently far away and then make a left turn, travelling westerly, onto road portion 17 of road 12. At the same time, however, pedestrians, normally following the "Walk" indicator on pedestrian traffic directing lights, may pass from corners 20 and 22 to corners 26 and 24, respectively. However, since pedestrians are crossing between corners 20 and 26, vehicular traffic on road 10 will, necessarily, have to wait until the pedestrians clear crosswalk 18, prior to making a right turn onto road portion 19 of road 12. In addition, the vehicular traffic on road portion 13 seeking to make a left turn onto the westerly directed portion 17 of road 12 must, not only await for the oncoming i.e., southerly vehicular traffic to be clear from intersection 14 but, in addition, the car must also await for the crosswalk, extending between corners 22 and 24 to also be clear of pedestrians.

As mentioned, this waiting for clearance of pedestrian from crosswalks, prior to making turns onto the perpendicular roadways, results in intermodal conflict o friction and necessarily backs up or delays the otherwise more free flow of vehicle traffic. The present invention is directed to a method and system for alleviating intermodal conflict or friction and, in its preferred embodiment is intended to be superimposed onto my loop interconnecting roadway system, the subject of my '288 patent.

Clearly, when traffic light 16 provides a red or stopping signal to traffic in the north and south direction on road 10, it simultaneously provides a green or go signal to traffic flow in the east/west directions on road 12. When the traffic signal 16 turns green for traffic to flow in the east/west direction on road 12, it simultaneously provides a red or stop signal for traffic flow in the north/south direction of road 10.

Figure 2:
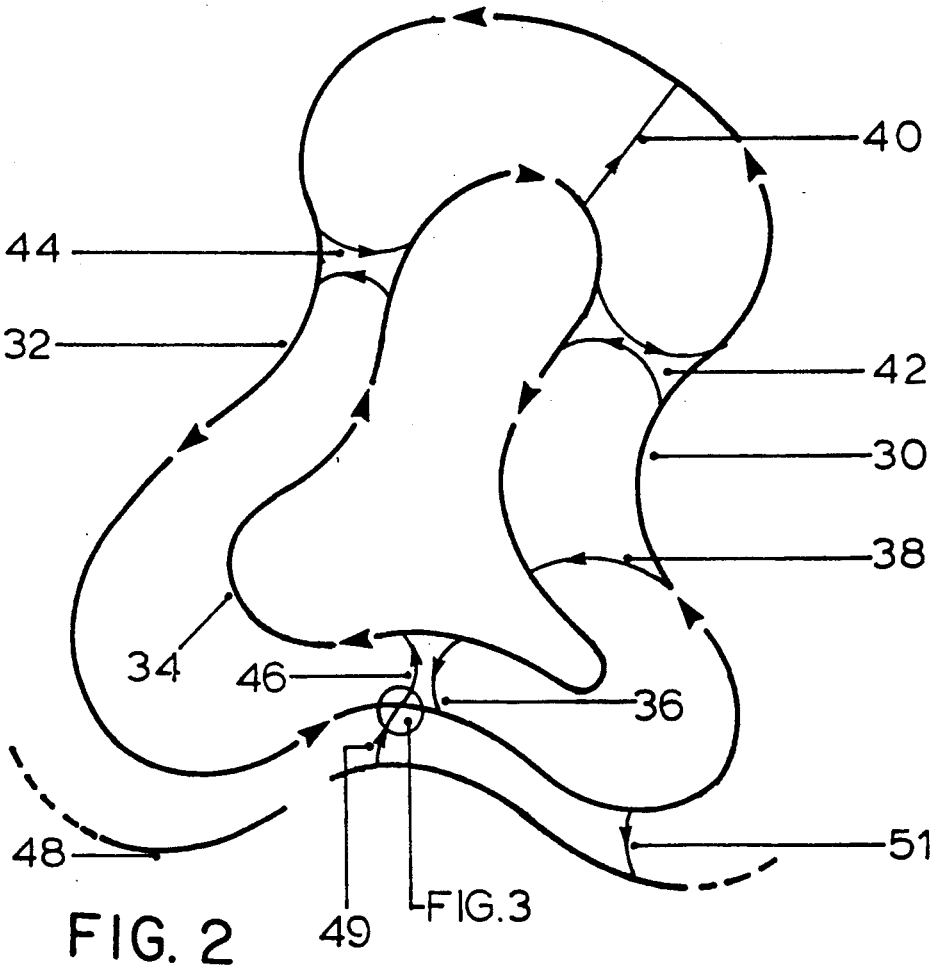
FIG. 2 is a schematic, representational birds-eye view of the most basic form of the endless loop and interconnecting roadway network the '288 patent.

FIG. 2 is a schematic representation of a basic building block of my loop interconnecting roadway. As best seen in FIG. 2, "building block" 30 of a loop road network is shown. It comprises a first endless loop 32 of roadway having traffic flowing in a first and only direction. The first loop 32 is, preferably, provided with signs serving to indicate to the drivers of vehicles on the roadway the proper direction of traffic flow on the endless loop. As depicted in FIG. 2, for illustration purposes, the one-way direction of traffic flow on endless loop 32 is the counterclockwise direction. It should be appreciated that endless loop 32 can take a variety of shape configurations as, for example, the endless loop can be rectangular, square, circular, oval, irregular, etc. Irrespective of shape, however, it is important that the loop of roadway be basically endless and carry traffic in a first and only one-way direction of travel.

A second endless loop 34 of roadway is provided. This second endless loop 34 is also provided with suitable traffic indicating signs and directs travel in a second and only one-way direction, which is directly opposite in direction to the direction of traffic flow on the first endless loop 32. According to the example shown in the FIG. 2, the traffic flow of direction on second endless loop 34 is relatively clockwise. The second endless loop 34 need not necessarily match the shape configuration of first endless loop 32 and can from the variety of shapes as first loop 32.

As can be seen in FIG. 2, the first endless loop 32 of roadway fully surrounds and contains the second endless loop 34 of roadway. Thus, as can be appreciated by a review of FIG. 2, no vehicular traffic crosses over or in front of other vehicular traffic.

So as to interconnect vehicular traffic from loop to loop and to allow traffic to selectively change between the first endless loop 32 and the second endless loop 34, if desired, a two-way loop to loop interconnecting roadway 36 is provided. Loop to loop interconnecting roadway 36 serves to facilitate traffic flowing on endless loop 32, for example, to transfer onto and easily merge into the traffic flow on second endless loop 34, without crossing over any traffic flowing on either of the two loops. Thus, loop to loop interconnecting roadway 36 serves to interconnect and allow transfer of traffic between the two loops of traffic 32 and 34. In the preferred embodiment, roadway 36 can be a simple two-lane roadway having a traffic barrier or divider down the center or, alternatively, two physically separate roadways or streets, 38 and 40 can be provided. In either case, the loop to loop interconnecting roadway 36 allows traffic to flow between the loops 32 and 34 without the vehicles intersecting or crossing over traffic already flowing on the loops. This is all fully described in my '288 patent.

Several two-way loop to loop interconnecting roadways 36 can be provided serving to connect, at a plurality of locations, the traffic flow between the first loop 32 and the second loop 34. Thus a vehicle travelling, for example, on the first loop 32 and desiring to transfer to the second loop 34 does not have to go entirely around the endless loop 32 to reach interconnecting roadway 36 but, rather, the vehicle can take any one of several available interconnecting roadways 42 and 44.

The direction of traffic flow on each side of the roadway 36 (if a single road is split down the center) or on roadways 38 and 40 (if paired roadways as used), is such that the traffic first flowing on the first endless loop 32 will, for example, take a left side exit off of loop 32, onto the interconnect roadway portion 46 (connecting traffic from loop 32 onto inner loop 34) and, when transferring from endless loop 34, as at interconnect roadway 42, again, a simple left side merge is performed. The direction of traffic flow for loop to loop interconnecting roadways are dictated by the direction of traffic flow on the endless loops. Thus, selecting a first direction of traffic flow on one of the endless loops predetermines the direction of traffic flow on the other endless loop (adjacent loops have traffic flowing opposite to one another) and that, in turn, predetermines the direction of traffic flow on both portions of the loop interconnecting roadways 36.

Other endless loops 48 can also be provided. Each of an adjacent pair of endless loops has traffic flowing in opposite direction to its adjacent loop and each pair is provided with at least one loop to loop traffic interconnecting roadway or a pair of roadways, as at 49 and 51.

With the above descriptions as background, the present invention relates to a mechanism for controlling vehicle traffic and pedestrian traffic and, in its preferred embodiment, is intended to be superimposed onto the roadway network system shown in FIG. 2.

Figure 3:
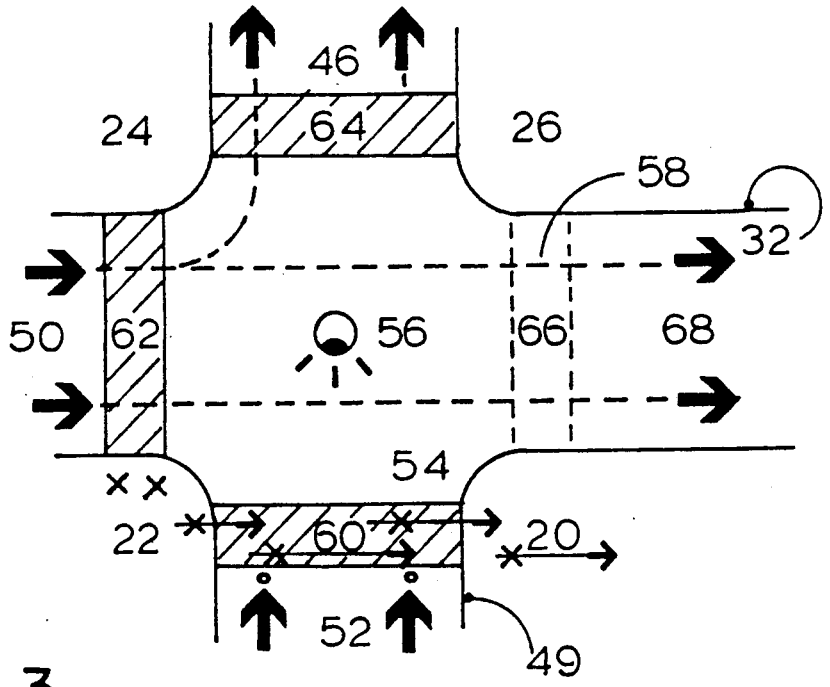
FIG. 3 is a schematic, representational birds-eye view of a roadway intersection where a portion of a loop to loop interconnecting roadway of the endless loop roadway system intersects with a portion of one of the endless loops. This view shows vehicles stopped upstream of the intersection along a first portion of the loop to loop interconnecting roadway so that pedestrians may pass in front of the stopped vehicles i.e., they may cross in the same direction of traffic flow as that of the vehicles on the endless loop, with vehicular traffic passing through the intersection and continuing on the loop and, in addition, with the vehicular traffic also able to transfer from the endless loop onto another portion of the loop to loop interconnecting roadway downstream of the center of the intersection.

Now, with reference to FIG. 3, it illustrates a schematic or birds-eye view of an intersection of a portion of a first endless loop 50 of roadway and a portion of the loop to loop interconnecting roadway 52. The endless loop 50 corresponds, for example, to the endless loop 32, shown in FIG. 2. The portion 52 of loop to loop interconnect roadway shown in FIG. 3 corresponds to the encircled portion of FIG. 2 and includes a portion of loop interconnect 49 and 46.

Portion 50 of loop 32, shown in FIG. 3, shows traffic on the endless loop which is allowed to flow in the west to east direction. Portion 52 of the loop to loop interconnecting roadway 49 corresponds to one section of the loop to loop interconnecting roadway which allows traffic to transfer from endless loop 48 to endless loop 32 while portion 46 provides for traffic to flow from endless loop 32 to endless loop 34. Thus, an intersection 54 is provided. At the center of the intersection 54 is a traffic mechanism or signal 56 which is ordinarily four-sided and can provide a red or green light facing each of the roadways which form intersection 54. Only two adjacent sides of the traffic light are required for the present invention. The signals must face oncoming traffic on portions 52 and 50.

According to the manner of vehicular traffic flow on my endless loop network of roadways, traffic may flow from west to east on endless loop 32 while, at the same time, traffic may flow from portion 50 of endless loop 32 onto loop to loop interconnect roadway 46, i.e., it is allowed to make a left turn. Also, at the same time, traffic is flowing from endless loop 48 (See FIG. 2), onto portion 52 of loop to loop interconnecting roadway 49 so as to ultimately merge, by making a right turn, onto endless loop 32. Thus, it should be appreciated that no traffic is allowed to flow from roadway 49 through the intersection 54 and onto roadway portion 46, nor is traffic allowed to travel from section 50 of endless loop 32 onto portion 52 of loop to loop interconnecting roadway 49. Suitable traffic directing signs can facilitate permissible and impermissible vehicle flow.

The traffic light 56 is required, not for vehicular traffic flow (since no traffic crosses other traffic) but, rather, to allow pedestrians to cross the streets in safety and to transfer from corner to corner. Crosswalks 58 are provided which define, by suitable paint markings, the locations where pedestrians are directed in order to safely cross from one corner to another corner. For illustrative purposes, crosswalk 60 connects the southeast corner 20 of intersection 54 to the southwest corner 22 while crosswalk 62 connects corner 22 to the northwest corner 24. Crosswalk 64 allows pedestrians to transfer between corner 24 and northeast corner 26.

According to the present invention, traffic light 56 will alternately provide a green light or "go" indication directed toward roadway portion 52 or a red light indication. Similarly, traffic light 56 will alternately provide a green light or "go" indication to loop portion 50 or a red or "stop" signal to traffic located there. Clearly, when the traffic light 56 shows red to roadway portion 52 it simultaneously provides a green signal to the traffic on loop portion 50, and vice versa. Since no traffic from roadway portion 46 or from the east side of loop portion 68 faces traffic light 56, those two sides of the traffic light need not have any traffic signal indicators or lights or, alternatively, they can both be provided with constant solid red light indicators to prevent and direct traffic from accidentally going down the roadways in the wrong intended direction.

When traffic light 56 shows a green or "go" signal to the loop portion 50, vehicular traffic travelling on loop 32 is free to go straight through intersection 54 onto the portion 68 of the loop and continue around endless loop 32. The vehicles are also allowed to make a left merge onto interconnect roadway portion 46 so as to travel to the adjacent endless loop 34. At the same time, the traffic light 56 is providing a red or stop signal to vehicle traffic on the roadway portion 52, which serves to stop that traffic from even entering into the intersection 54. During the time the green light is provided to the traffic on the loop portion 50, pedestrians are allowed and directed by pedestrian crosswalk signals to cross between corners 20 and 22. Thus, pedestrians cross in front of the stopped vehicle traffic which is located on loop to loop interconnecting portion 52.

Then, after a suitable duration of time (in the preferred embodiment, 40 seconds of green light for loop roadways 32 are provided for every twenty seconds of green light on the loop to loop interconnects 49) the traffic light changes so as to provide a red or "stop" signal to the traffic flow on loop roadway 50 and a green or "go" signal to the traffic formerly stopped on loop to loop interconnecting roadway 52. Now, the vehicle traffic on the roadway portion 52 is allowed to turn right and to enter onto the loop 32 by travelling onto portion 68 of loop 32. Again, none of the vehicle traffic on loop to loop interconnecting roadway portion 52 is allowed to cross over intersection 54 and enter onto portion 46 of the downstream loop to loop interconnecting roadway 36. During this time duration, i.e., when the green traffic signal is directed toward the vehicle traffic on portion 52, pedestrians are able to transfer between corners 22 and 24 and, in addition, between corners 24 and 26. Since no vehicle traffic is going from portion 52 to downstream roadway portion 46, nor is there any traffic flow from portion 50 through the intersection 54 (the traffic there is stopped before crosswalk 62), there is no intermodal conflict or friction between the pedestrians crossing crosswalks 62 and 64 and the vehicles turning onto loop portion 68.

Then, after a suitable time duration, in the preferred embodiment, twenty seconds, the traffic signal 56 changes and again provides a green or go signal to the vehicle traffic on loop portion 50 and a red or stop signal to the vehicle traffic on the portion 52 of loop to loop interconnecting roadway 36. The cycle repeats over and over.

Thus, it should be appreciated from the above, that the present method and system allows for pedestrians and vehicles to utilize the loop interconnect roadway network without intermodal conflict or friction and, yet, the pedestrians can travel from any corner of a city block to any other corner. This allows the vehicles to travel in a far greater and continuous manner. However, it should be appreciated that if a pedestrian desires to travel from corner 20 to 26 he cannot simply cross directly over crosswalk 66 but, rather, he must first cross from corner 20 to 22, then cross from corner 22 to 24 and then walk from corner 24 to 26 or, the reverse, if from corner 26 to 20. The reason that the pedestrian cannot simply cross from corner 20 directly to corner 26 or vice versa is because, at all times, traffic is flowing across crosswalk 66. This is because traffic either crosses crosswalk 66 by coming from loop portion 50 or, alternatively, vehicle traffic is entering section 68 of the loop roadway from portion 52 of the interconnecting roadway 36.

FIG. 3 is a schematic representation of the intersection with a green light directed at portion 50, red light toward portion 49 and pedestrians allowed to cross between corners 20 and 22.

Figure 4:
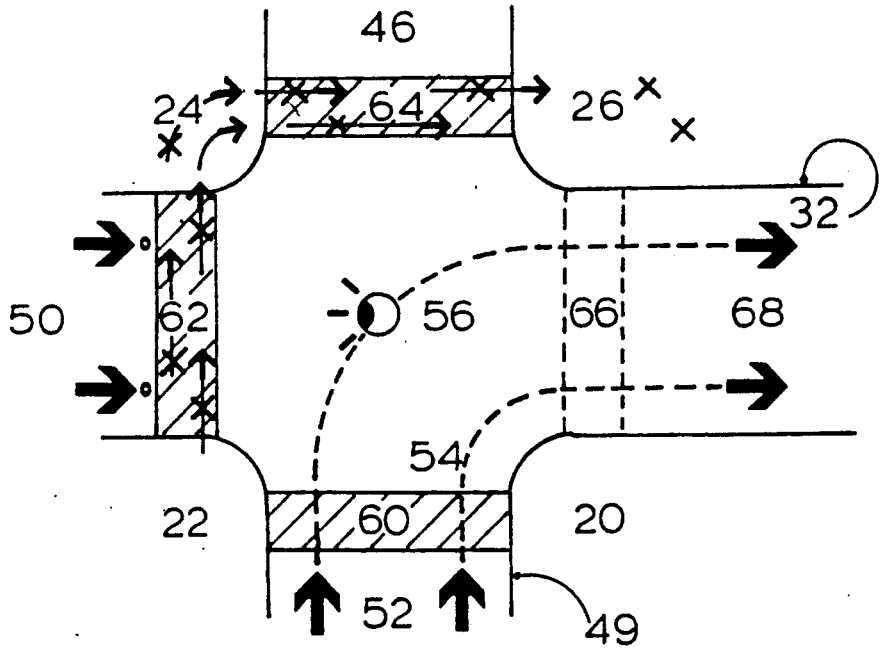
FIG. 4 is a schematic, representational bird's eye view of a similar roadway intersection of the loop to loop interconnecting roadway. This view shows vehicles blocked from continuing on the loop, through the intersection and, yet, vehicle traffic from the loop to loop interconnecting roadway may enter onto the loop. Now, pedestrians can cross the street in front of the stopped loop traffic and on the far side of the intersection, i.e., on the crosswalk opposite to the loop to loop interconnecting road portion.

FIG. 4 shows the same intersection as shown in FIG. 3 with the red or "stop" signal of the traffic light 56 being directed to portion 50 of the loop 32 and the green or "go" signal allowing traffic to flow from portion 52 of the loop to loop interconnecting roadway and pedestrians allowed to cross between paired corners 22 and 24 and 24 and 26.

Inasmuch as the present invention is subject to many variations, modifications and changes in details, it is intended that all matter contained in the foregoing description or shown in the accompanying drawings shall be interpreted as illustrative and not in a limiting sense. The scope of protection I am entitled to is only limited by the appended claims, as interpreted by the courts.

I claim:

1. A method of controlling vehicle and pedestrian traffic at a street intersection of two streets comprising the alternating steps of:

(a) stopping vehicular traffic on a first section of a first of said streets, upstream of said intersection, thereby allowing pedestrians to cross the path of said stopped vehicular traffic and to transfer between corners adjacent to said stopped vehicular traffic, while, at the same time, allowing vehicle traffic on said second of said streets to either:

(i) travel across said intersection to continue on said second of said streets; or (ii) turn onto said first street, downstream of said intersection; and (b) stopping vehicle traffic on said second of said streets, upstream of said intersection, thereby allowing pedestrians to cross the path of said stopped vehicle traffic and to transfer between corners adjacent to said stopped vehicular traffic, while, at the same time, allowing vehicle traffic on said first of said streets to only turn onto said second of said streets, downstream of said intersection, and also allowing pedestrians to transfer between corners opposite to said vehicle traffic on said first street, downstream of said intersection.

2. A method as claimed in claim 1 wherein said two streets are substantially perpendicular to one another.

3. A method as claimed in claim 1 wherein said streets only carry vehicle traffic in one direction.

4. A method as claimed in claim 1 wherein the minimum time duration for said step (b) is determined by the length of time for pedestrians to walk across the path of said stopped vehicle traffic so as to transfer between said corners adjacent to said stopped vehicular traffic.

5. A method as claimed in claim 1 wherein said step (a) is timed for twice the length of time as said step (b).

6. A method as claimed in claim 5 wherein said step (a) occurs for about forty seconds.

7. A method as claimed in claim 1 wherein said two street intersection is part of an endless loop interconnecting roadway system.

8. A method as claimed in claim 7 wherein said endless loop interconnecting roadway system comprises:

(a) a first endless loop of roadway carrying vehicular traffic in a first direction of traffic flow;

(b) a second endless loop of roadway carrying vehicular traffic in a second, opposite direction of traffic flow to that of said first endless loop of roadway, said second endless loop of roadway surrounding said first endless loop of roadway and having no crossovers or intersections; and (c) at least one loop to loop interconnecting roadway, connecting said first endless loop of roadway to said second endless loop of roadway, said loop to loop interconnecting roadway having at least one roadway portion allowing vehicle transfer between said first endless loop of roadway and said second endless loop of roadway, said loop interconnecting roadway allowing said vehicles to merge into said first and said second endless loops of roadway without crossing over the path of travel of said vehicles travelling on said endless loops of roadway.

9. A method of controlling vehicle and pedestrian traffic comprising the steps of:

(a) directing vehicular traffic on a first, one-way traffic direction endless loop of roadway;

(b) directing vehicular traffic on a second one-way direction endless loop of roadway, opposite in direction to the direction of traffic on said first endless loop, said second endless loop fully surrounding, without intersecting, said first endless loop;

(c) directing vehicular traffic to selectively transfer between said first and said second endless loops of roadway by travelling on a loop to loop interconnecting roadway, a first section of said loop to loop interconnecting roadway having one-way vehicular traffic flow from said first endless loop of roadway to said second endless loop of roadway and a second section of said loop to loop interconnecting roadway having one-way vehicular traffic flow from said second endless loop of roadway to said first endless loop of roadway;

(d) alternatingly, stopping and allowing travel of said vehicular traffic, at timed intervals, by a traffic signal means which directs said vehicular traffic to stop upstream of an intersection on either of said first or said second endless loops of roadway and said loop to loop interconnecting roadway or to travel through said intersection; and directing pedestrians to cross said roadways at crosswalks through which no vehicular traffic is travelling; and (e) directing said pedestrians to cross in front of stopped vehicular traffic on either said first or said second endless loops of roadways and, at the same time, in front of yet upstream of vehicular traffic turning from said loop to loop interconnecting roadway onto either said first or said second endless loop of roadway.

10. A method of controlling vehicular and pedestrian traffic at an intersection formed by two crossing roadways, comprising, (a) permitting only one-way flow of vehicular traffic toward said intersection on both of said roadways;

(b) permitting, by means of a traffic signal at said intersection in a first condition thereof, the vehicular traffic on a first of said roadways to either:

(i) enter said intersection and continue on said first roadway, or (ii) enter said intersection and turn onto said other roadway in the one-way direction thereof;

(c) stopping, at the intersection, all vehicular traffic on said other roadway when said traffic signal is in said first condition thereof;

(d) permitting, when said traffic signal is in a second condition thereof, the vehicular traffic on said other roadway to enter said intersection and turn onto said first roadway in the one-way direction thereof, and (e) stopping, at the intersection, all vehicular traffic on said first roadway when said traffic signal is in said second condition thereof, whereby when said traffic signal is in its first condition, pedestrian traffic may cross said stopped vehicular traffic on said other roadway; and when said traffic signal is in its second condition, pedestrian traffic may cross said first and said other roadway.

11. A method as claimed in claim 11 wherein said pedestrian traffic crosses said first roadway before said intersection.

12. A method as claimed in claim 11 wherein said pedestrian traffic crosses said other roadway after said intersection.

* * * * *